United States Patent [19]

Humphreys

[11] 4,321,881

[45] Mar. 30, 1982

[54] METHOD AND APPARATUS FOR INSERTING A GUSSET IN PANTI-HOSE

[76] Inventor: John C. Humphreys, 3 Cowper Rd., Burbage, Hinckley, Leicestershire, England

[21] Appl. No.: 102,125

[22] Filed: Dec. 10, 1979

[30] Foreign Application Priority Data

Dec. 12, 1978 [GB] United Kingdom ..... 48190/78
Sep. 12, 1979 [GB] United Kingdom ..... 31577/79

[51] Int. Cl.[3] ..... D05B 97/12; D05B 21/00
[52] U.S. Cl. ..... 112/262.2; 112/121.15
[58] Field of Search ..... 112/121.15, 121.11, 112/121.12, 121.29, 2, 63, 262.1, 262.2

[56] References Cited

U.S. PATENT DOCUMENTS 3,777,681 12/1973 Horita ..... 112/121.15
4,188,898 2/1980 Bell, Jr. et al. ..... 112/121.15 X
4,196,681 4/1980 Chietti ..... 112/121.15
4,220,104 9/1980 Humphreys ..... 112/121.15 X
4,224,885 9/1980 Takatori ..... 112/121.15

*Primary Examiner*—H. Hampton Hunter

[57] ABSTRACT

The present invention relates to a method of seaming a gusset to a garment characterized by supporting the garment (10) on a support which comprises an elongate member (70) open at one end onto which the garment is drawn and inner support means (74) displaceable relative to said member for gripping said gusset (22); presenting the gusset (22) to and supporting it at said one end of the support with the periphery of the gusset overlapping the periphery of an opening in the garment for receiving the gusset, said gusset being stretched at least in one direction to a preselected extent, and mechanically seaming the garment and the periphery of the gusset together while simultaneously rotating the gusset and the garment relative to a seaming machine and through at least 360° about an axis passing through the gusset to secure the gusset to the garment by a single continuous seam.

17 Claims, 6 Drawing Figures

METHOD AND APPARATUS FOR INSERTING A GUSSET IN PANTI-HOSE

The present invention relates to hosiery and particularly to the fixing of gussets on panti-hose or similar garments.

Hitherto the seaming of gussets to panti-hose or similar garments has been effected either by hand using a single seam or by machine using two or more seams.

It has hitherto proved difficult to seam mechanically a gusset to a garment by a single continuous seam and in practice seaming has been effected by two or more machines producing separate portions of the final seam.

The present invention seeks to provide an improved manner of mechanically seaming gussets in garments.

Accordingly the present invention provides a method of seaming a gusset to a garment comprising supporting the garment on a support which comprises an elongate member open at one end onto which the garment is drawn and inner support means displaceable relative to said member for gripping said gusset; presenting the gusset to and supporting it at said one end of the support with the periphery of the gusset overlapping the periphery of an opening in the garment for receiving the gusset, said gusset being stretched at least in one direction to a preselected extent, and mechanically seaming the garment and the periphery of the gusset together while simultaneously rotating the gusset and the garment relative to a seaming machine and through at least 360° about an axis passing through the gusset to secure the gusset to the garment by a single continuous seam.

Preferably the gusset and the garment are mechanically seamed by a seaming machine whose position relative to the axis of rotation is variable radially to said axis and during rotation to enable said machine to follow the gusset periphery.

Conveniently the garment and the gusset are rotated by rotating said support about its longitudinal axis of said member.

Preferably the gusset is stretched laterally in one direction.

In a preferred embodiment the gusset periphery and the garment are maintained in a desired attitude for seaming thereof by guide means, advantageously by the application of suction and air jets.

The present invention also provides apparatus for seaming a gusset to a garment comprising a support for receiving said garment, said support comprising an elongate support member open at one end onto which the garment is arranged to be drawn and inner support means displaceable relative to said member for gripping the gusset so as to enable an opening in the garment to be brought into overlapping relationship with the periphery of the gusset; means for presenting said gusset to said inner support means and stretching said gusset in at least one direction to a preselected extent; a seaming machine for seaming the gusset and the garment together, said support being displaceable relative to said machine to bring the machine into engagement with the garment and gusset, and wherein said support is rotatable relative to the seaming machine through an angle of at least 360° and about an axis arranged to pass through the gusset to enable the gusset to be secured to the garment by a single continuous seam.

Conveniently the elongate member comprises a substantially tubular member over which the garement is arranged to be drawn with the garment opening adjacent an open end of the member.

In a preferred embodiment the inner support means comprises clamping means for gripping the peripheral region of the gusset at or adjacent the open end of said elongate member. Advantageously the clamping means comprises a plurality of needles desplaceable to grip the gusset between said needles and said elongate member. The degree of stretching of the gusset is important since it basically determines the overall size and shape of the finished gusset after sewing. The shape of the gusset can be varied between a circular and a narrow oval shape by suitably selecting the degree of gusset stretch.

The present invention is further described hereinafter, by way of example, with reference to the accompanying drawings, in which.

Figure 1:
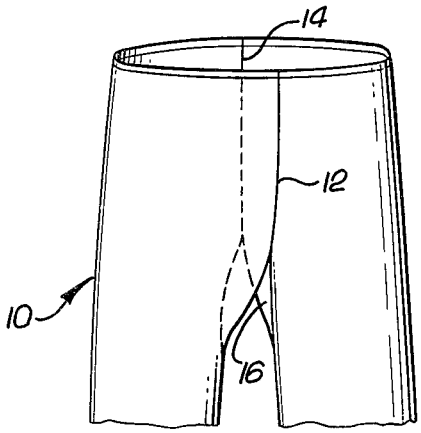
FIG. 1 shows the body portion of a pair of panti-hose.

The panti-hose body 10 illustrated in FIG. 1 is seamed at the front and rear at 12 and 14 to leave the crotch 16 open. The panti-hose may be manufactured to this stage either by conventional means or by sing the facility available on some automatic line closing panti-hose seaming machines. Although the crotch 16 is shown as being left open to receive a gusset made of any suitable flat fabric which may be knitted, woven or non-woven, the crotch may be fully seamed and a piece of fabric removed to form an opening to receive a gusset as is described below. The size and shape of the gusset are chosen to suit particular requirements.

Figure 2:
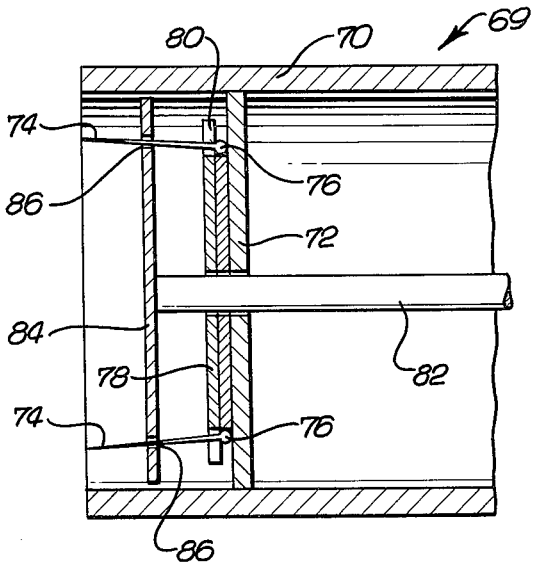
FIG. 2 is a section through one embodiment of an apparatus according to the present invention.

FIG. 2 is a cross-section through one form of apparatus 69 of the present invention and comprises a circular cross-section tube 70 in which is rigidly mounted a circular plate 72. The plate 72 pivotally supports a plurality of needles 74 each of which has a head 76 sandwiched between the plate 72 and a clamping plate 78 of slightly smaller diameter. The needles 74 are spaced about the perimeter region of the plate 72 and are pivotable in a direction radially of the tube axis through radial slots 80 in the plate 78. Each slot is wide enough to allow the needle to pivot freely but narrow enough to prevent passage of the needle head. Passing through the plates 72, 78 is a rod 82 which is slidable axially of the tube 70 and carries a further plate 84. The latter has holes 86 through which the needles freely project.

In use, the panti-hose body 10 is turned inside out and stretched over the tube 70 with the front end of the tube projecting through the gusset opening. Where the latter has not been cut the body 10 is stretched over the tube and clamped in position and the opening then cut or preferably burned out with suitable means such as a heated wire of the desired shape. The body is then drawn back over the tube 70. A required length of gusset 22, conveniently cut from a roll of gusset material, is stretched sufficiently to cover the front opening of the tube 70 and is then presented thereto after the plate 84 is driven forward to pivot the needles to their radially innermost position. In this position the needle tips preferably project fractionally beyond the mouth of the tube and engage through the gusset material.

If necessary, suitable means such as a circular brush is used to tap the gusset onto the needles.

The plate 84 is then retracted to force the tips of the needles 74 against the inner wall of the tube 70 and grip the gusset, still in its stretched form, in position but leaving the gusset edge projecting out of the tube. The needles 74 conveniently carry shoulders or other suitable stops adjacent their tips to prevent the gusset riding down the needles. The panti-hose body is then drawn forward along the tube 70 from right to left as seen in FIG. 2 and 3 until the edge of the gusset opening overhangs the end of the tube 70 and is aligned with the gusset edge ready for sewing.

The apparatus is then moved to bring the overhanging portions of the gusset 22 and body 10 into position between the needle bar assembly 30 and throat or needle plate 32 of a seaming machine such as an overlocking or cup seaming machine. The tube assembly with the body 10 and gusset 22 are rotated about the tube axes through at least 360° while the overlocking machine is running to seam the gusset 22 and body 10 together. The seam produced is at right angles to the seams 12 and 14.

The axis of the overlocking machine camshaft (not shown) is conveniently in the same horizontal place as the tube axes, and the gusset 22 and body 10 are conveniently held in position and guided by for example suitable guides and air or gas jets.

Figure 3:
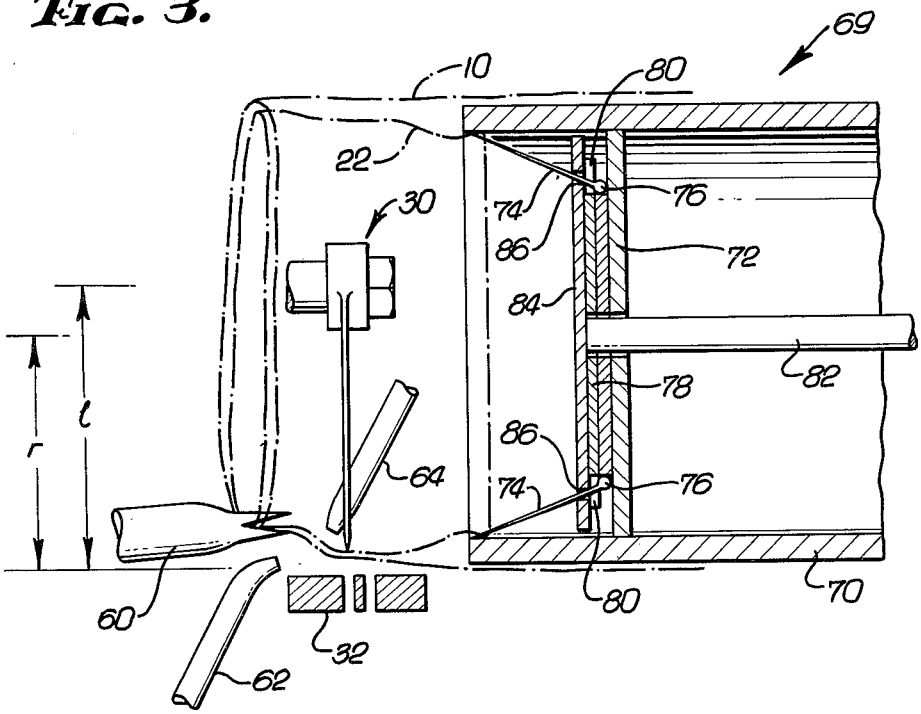
FIG. 3 shows the seaming of a gusset into the panti-hose (not to scale)

FIG. 3 shows three air jet nozzles 60, 62 and 64.

The nozzle 60 is a suction nozzle located in front of the needle adjacent the sewing path to draw out the edges of the gusset 22 and body 10 into the required sewing position. The nozzle 60 preferably has a flattened mouth conveniently in a fan-tail shape with its side edges slotted to allow the edges of the gusset and body partially to enter the mouth and so ensure a more efficient orientation of the edges for sewing. The nozzle 64 is a pressure nozzle which is located adjacent the needle and directs a jet of air at the gusset and body edges of sufficient force to retain the edges in the required sewing position otherwise once past the suction nozzle 60 the latter could spring back out of the needle path as a result of the natural resilience of the material. A plurality of nozzles 60 and 64 may be provided.

Cutting means such as knives (not shown) are provided to trim the edges prior to sewing and the suction nozzle 62 draws off the trimmed waste.

Once the gusset has been stitched to the body the plate 84 is moved forward to release the gusset from the needles and the panti-hose is drawn off the tube.

In a modified form (not shown) of the invention the needle bar assembly is located outside the cup-shape of gusset with the plate 32 inside.

Once seaming of the gusset is complete the panti-hose is removed from the apparatus for example by suction applied to pull the panti-hose off the end of the tube 70.

By verying either or both the rotational speed of the tube assembly and the speed of the overlocking machine the number of stitches per inch of the gusset seam can be varied. The seam may be of single or twin needle form.

The tube 70 need not be integral but may comprise, for example a number of paralleled rods or other suitable members arranged in a tube-like formation.

Although the assembly mounting the body 10 is illustrated in a horizontal attitude it may conveniently be orientated at some other attitude, for example vertically. However, additional control of the fabric may then be necessary.

Figure 4:
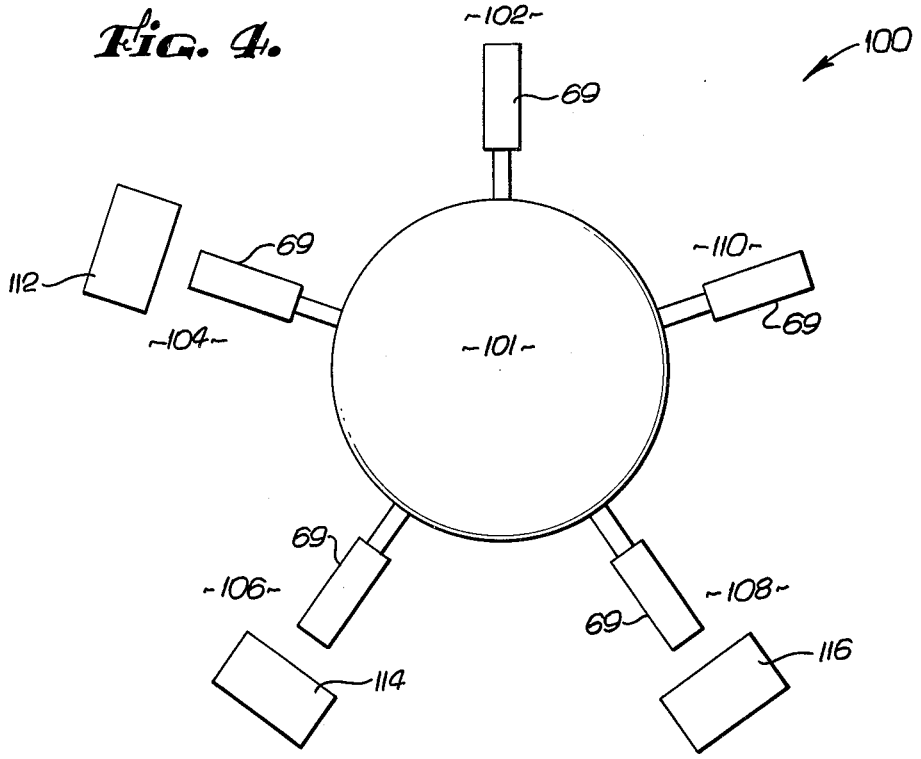
FIG. 4 is a diagramatic plan view of a practical embodiment of the present invention.
Figure 6:
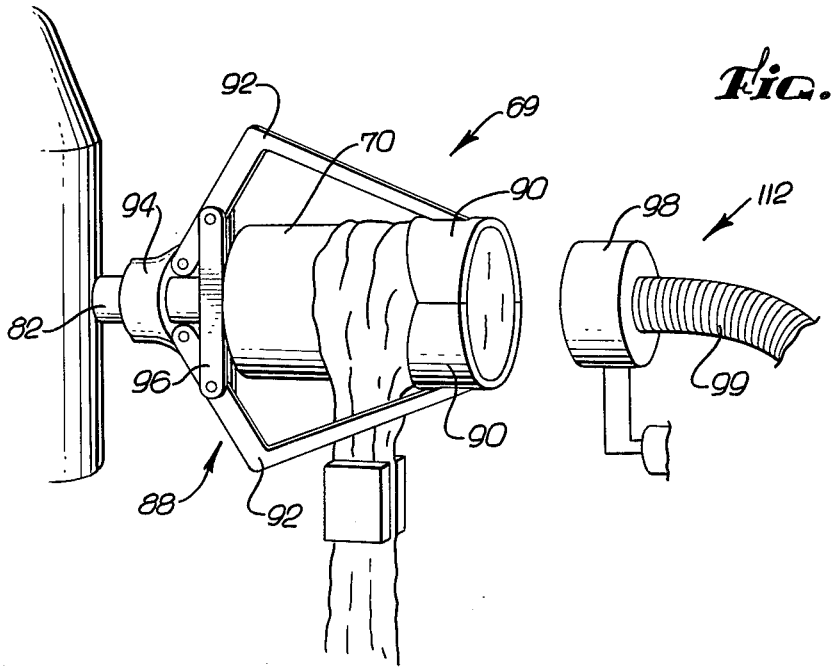
FIG. 6 is a perspective view of one station of the apparatus of FIG. 4.

FIG. 4 is a diagramatic view of a machine 100 which comprises a turret 101 which mounts five apparatus 69 angularly spaced at equal intervals about the turret. The turret is rotatable to move each apparatus 69 successively through five stations 102 and 110, at each of which one operation in the seaming of a gusset to panti-hose is carried out. FIG. 6 is a perspective view of staion 106 and shows clamps 88 which holds the panti-hose stretched in position on the tube 70. The various movable parts of each apparatus 69 such as the rod 82 and the clamps 88 for clamping the panti-hose body about the tube 70 are actuated by way of levers coupled to stationary cams (not shown) in the turret.

At the first station, 102, a panti-hose body is stretched over the tube of the apparatus 69 as described above with reference to FIGS. 2 and 3, and clamped in position. Each clamp 88 comprises a half-cylindrical member 90 which is of slightly larger diameter than the tube 70 to enable the panti-hose to be gripped therebetween. The member 90 is preferably padded with a suitable resilient material on its inner surface to avoid damaging the panti-hose and provide a firm grip. Each member 90 is rigidly secured to an L-shaped lever 92 the shorter arm of which is loosely pivoted at its free end to a further member 94 which is slidable coaxially of the rod 82. The shorter arm of each lever is also pivoted intermediate its ends to a respective end of a support 96 such that movement of the member 94 towards and away from the support 96 and tube 70 pivots the members 90 respectively away from the tube 70 and into engagement with the tube 70.

The apparatus 69 is then rotated to staion 104 where a suitable means 112 such as a hot wire burns out a hole for the gusset.

FIG. 6 shows a cup-shaped housing 98 in which the hot wire is supported. The latter is substantially circular in shape and is slightly forward of the mouth of the housing 98. When the housing 98 is moved forward it carries the wire into engagement with the panti-hose to burn out a hole for the gusset. A flexible tube 99 connects the housing 98 with a vacuum source to draw away the waste material burned out of the panti-hose. The apparatus 69 is then rotated to station 106 where a length of gusset is cut from a roll and applied to the apparatus 69 by suitable means 114 one example of which is described in detail below.

At station 108 the gusset is seamed to the panti-hose body by a sewing machine 116 and the seamed edges trimmed. Finally at station 110 the completed panti-hose is drawn off.

Figure 5:
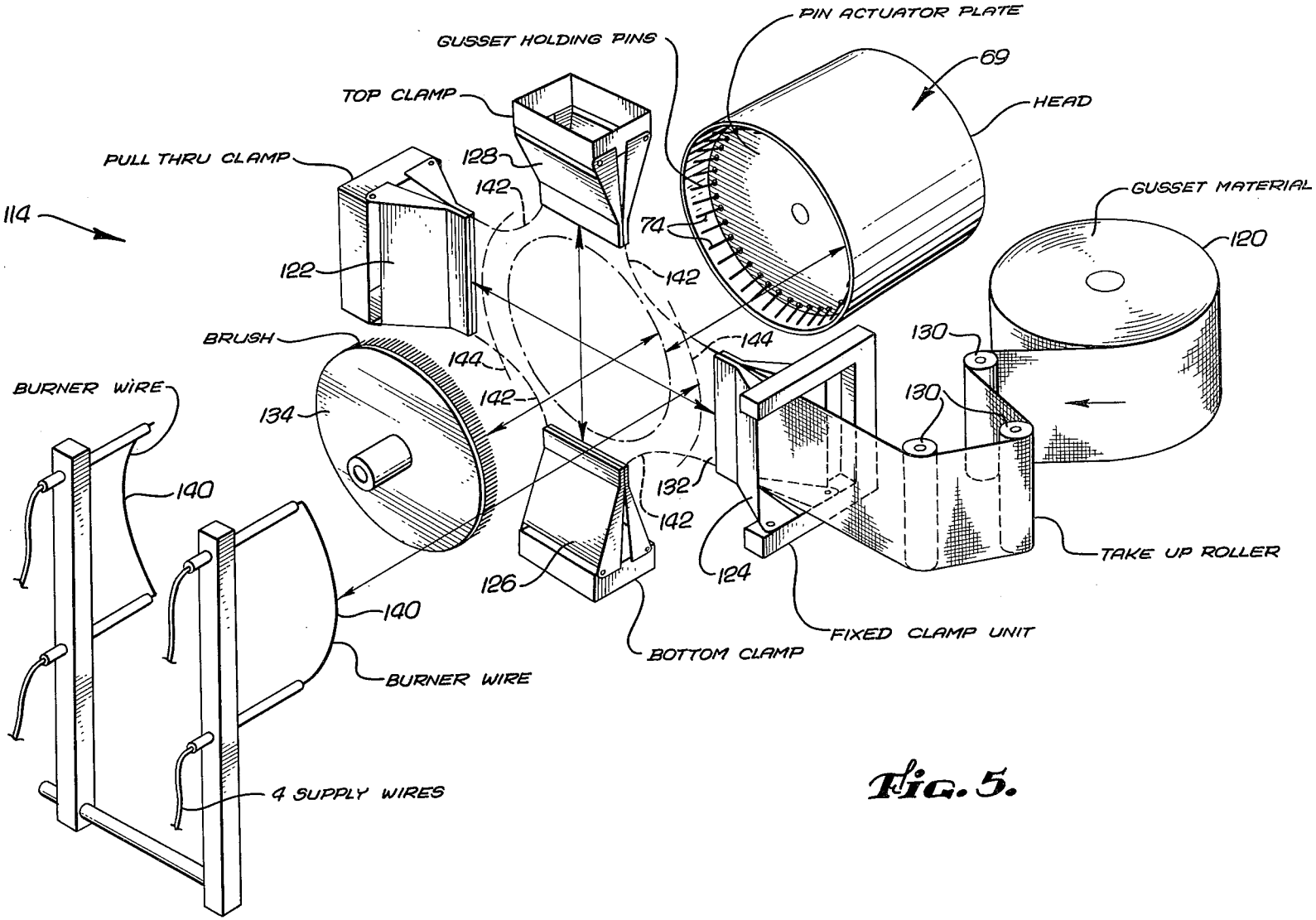
FIG. 5 is a perspective view of a portion of an apparatus for selecting and stretching a length of gusset material.

FIG. 5 shows a device 114 for cutting a gusset length from a roll 120 of gusset material and applying it to the apparatus 69. The device includes two pairs of opposing clamps 122 to 128 one pair being aligned horizontally and the other pair being aligned vertically. The two clamps 126 and 128 are movable towards and away from one another. The clamp 122 is movable towards and away from clamp 124 while the latter is fixed in position. Gusset material is drawn from the roll 120 around one or more take-up rollers 130 and gripped by clamp 124. Once apparatus 69 has moved into position facing the space bounded by the clamps, the clamp 122 is moved from left to right as seen in FIG. 5 and opens to grip the leading edge 132 of the gusset material. The clamp 124 then opens and clamp 122 retracts to its initial position drawing a length of gusset material from the roll, the clamp 124 then reclamping the gusset material. The moment at which clamp 124 reclamps the gusset material determines the amount of lengthwise stretch, if any, is applied to the gusset. The clamp 124 may re-engage the gusset material while the clamp 122 is still retracting. If no lengthwise stretch is required then the clamp 124 does not re-engage until clamp 122 has retracted to its initial rest position. The clamps 126 and 128 then move in, grip the side edges of the gusset material and return to their initial positions thus stretching the gusset material laterally. The degree of stretch of the material is determined by the positions to which the clamps 126, 128 retract and these can be adjusted to provide a desired amount of stretch. The final shape of the gusset in the panti-hose is determined by the amount of stretch applied to the gusset. However, the gusset material is sufficiently stretched to cover the mouth of the apparatus 69. The gusset material is then engaged by the needles 74 of the apparatus 69 by movement of one or both the gusset material and the apparatus 69, the material being pressed fully onto the needles by suitable means such as a brush 134 which is automatically brought into contact with the material.

Once the needles 74 have gripped the material a cutting means such as hot wires 140 are brought into contact with the material to cut out, or as in this case burn out the gusset. The stretched shape of the gusset is shown by the dotted lines 142 while the hot wires contsct the material along the lines 144.

With clamps 126 and 128 released the apparatus 69 is moved to the next station 108 where the gusset is stitched to the panti-hose by a sewing machine 116.

Finally the apparatus 69 is moved to station 110 where the completed panti-hose is removed preferably by suction.

The machine 100 shown in FIGS. 4 and 5 has a cycle time of approximately 5 seconds for each panti-hose.

While the present invention has been described in relation to panti-hose it will be apparent that it may be applied to any suitable garment requiring the addition of a gusset.

We claim:

1. A method of seaming a gusset to a garment characterised by supporting the garment (10) on a support which comprises an elongate member (70) open at one end onto which the garment is drawn and inner support means (74) displaceable relative to said member for gripping said gusset (22); presenting the gusset (22) to and supporting it at said one end of the support with the periphery of the gusset overlapping the periphery of an opening in the garment for receiving the gusset, said gusset being stretched at least in one direction to a preselected extent, and mechanically seaming the garment and the periphery of the gusset together while simultaneously rotating the gusset and the garment relative to a seaming machine and through at least 360° about an axis passing through the gusset to secure the gusset to the garment by a single continuous seam.

2. A method as claimed in claim 1 characterised in that said opening for receiving said gusset is made after said garment is drawn onto said member (70) and prior to presenting said gusset to said support.

3. A method as claimed in claim 2 characterised in that said opening is made by bringing a heated wire member into contact with said garment material.

4. A method as claimed in claim 1, 2 or 3 characterised in that said gusset is drawn from a length of gusset material, is stretched at least in one direction to a preselected extent, is gripped by said inner support means, and is then severed from said length of gusset material.

5. A method as claimed in claim 1 characterised in that the garment (10) and the gusset (22) are rotated by rotating said support about its longitudinal axis of said member (18).

6. A method as claimed in claim 1 characterised in that the gusset periphery and the garment are maintained in a desired attitude for seaming thereof by the application of suction and air jets (60).

7. A garment characterised by having a gusset seamed thereto according to the method as claimed in claim 1.

8. Apparatus for seaming a gusset to a garment characterised in that there is provided a support for receiving said garment, said support comprising an elongate support member (70) open at one end onto which the garment (10) is arranged to be drawn and inner support means (74) displaceable relative to said member (70) for gripping the gusset (22) so as to enable an opening in the garment to be brought into overlapping relationship with the periphery of the gusset; means (114) for presenting said gusset (22) to said inner support means (74) and stretching said gusset in at least one direction to a preselected extent; a seaming machine for seaming the gusset and the garment together, said support being displaceable relative to said machine to bring the machine into engagement with the garment and gusset, and wherein said support is rotatable relative to the seaming machine through an angle of at least 360° and about an axis arranged to pass through the gusset to enable the gusset to be secured to the garment by a single continuous seam.

9. Apparatus as claimed in claim 8 characterised in that the elongate support member (70) comprises a substantially tubular member over which the garment (10) is arranged to be drawn.

10. Apparatus as claimed in claim 9 characterised in that said inner support means (74) comprises a plurality of members displaceable between a first position wherein said members are arranged to penetrate the gusset material and a second position wherein said members retain said gusset in its stretched condition with its periphery adjacent the periphery of said garment opening.

11. Apparatus as claimed in claim 10 characterised in that each said member (74) is a needle pivotable in a direction radially of said elongate support member (70) and in said second position said members (74) grip the gusset against the elongate support member (70).

12. Apparatus as claimed in claim 8 characterised in that there is provided means for making said opening in said garment after said garment is drawn onto said elongate support member.

13. Apparatus as claimed in claim 12 characterised in that there is provided a carousel unit having a plurality of arms each carry a respective support, the unit being operable intermittently to rotate each support successively through a plurality of stations a first (104) of which has said means for making said opening in the garment.

14. Apparatus as claimed in claim 13 characterised in that a second station (106) comprises means for stretching said garment and presenting said gusset to said inner support means (74).

15. Apparatus as claimed in claim 14 characterised in that a fourth station (108) comprises said seaming machine.

16. Apparatus as claimed in claim 13 characterised in that said means for making said opening includes suction means for removing waste material.

17. Apparatus as claimed in claim 8 characterised in that there is provided a suction means for retaining the peripheries of said gusset and said opening in overlapping relationship during seaming of the gusset to the garment.

* * * * *

UNITED STATES PATENT AND TRADEMARK OFFICE

CERTIFICATE OF CORRECTION

PATENT NO. : 4,321,881

DATED : March 30, 1982

INVENTOR(S) : John C. Humphreys

It is certified that error appears in the above—identified patent and that said Letters Patent is hereby corrected as shown below:

On the title page add: --- [73] Assignee: Paramount Textile Machinery Co., Greensboro, N.C. ---

Signed and Sealed this

*Fifth* Day of *October 1982*

[SEAL]

*Attest:*

GERALD J. MOSSINGHOFF

*Attesting Officer*

*Commissioner of Patents and Trademarks*